United States Patent [19]

Yamaryo

[11] Patent Number: 4,793,235

[45] Date of Patent: Dec. 27, 1988

[54] KEY MECHANISM FOR A CLARINET

[75] Inventor: Shigeru Yamaryo, Hamamatsu, Japan

[73] Assignee: Yamaha Corporation, Japan

[21] Appl. No.: 133,564

[22] Filed: Dec. 16, 1987

[30] Foreign Application Priority Data

Jan. 6, 1987 [JP] Japan ..... 62-000898[U]

[51] Int. Cl.[4] ..... G10D 7/06

[52] U.S. Cl. ..... 84/382; 84/380 R

[58] Field of Search ..... 84/380, 382

[56] References Cited

U.S. PATENT DOCUMENTS 1,585,296 5/1926 Loomis ..... 84/382

3,015,981 1/1962 McIntyre et al. ..... 84/382

3,079,828 3/1963 Leblanc ..... 84/382

3,379,086 4/1968 Mazzeo ..... 84/382

3,941,026 3/1976 Hildebrandt ..... 84/382

*Primary Examiner*—Lawrence R. Franklin

*Attorney, Agent, or Firm*—Lerner, David, Littenberg, Krumholz & Mentlik

[57] ABSTRACT

In construction of a key mechanism for a clarinet having G# and A key units, release of a G# sound hole is mechanically inhibited by a control unit when a G# key is unexpectedly operated during regular operation on an A key for constant generation of a crisp A sound without any change in traditional finger motion.

4 Claims, 1 Drawing Sheet

KEY MECHANISM FOR A CLARINET

BACKGROUND OF THE INVENTION

The present invention relates to an improved key mechanism for a clarinet, and more particularly relates to an improvement in operation of G# and A key units of a key mechanism for a clarinet.

In construction of a clarinet, a key mechanism is arranged over the upper and lower joint. Among several key units in the key mechanism, a G# key unit having a G# key and an A key unit having an A key are spaced in close vertical superposition with partial crossing. The G# key is connected to a cap for controlling the state of a G# sound hole and the A key is connected to a cap for controlling the state of a A sound hole. For generation of a G# sound, the G# key is operated by the operator's left index finger in order to lift the associated cap from the G# sound hole. Similarly, for generation of an A sound, the A key is also operated by the left index finger.

Due to the above-described arrangement of the G# and A key units, the G# key and the A key are located quite close to each other and both are operated by a same finger. As a consequence, when a G# sound and an A sound are to be generated in succession during performance, approach of the index finger to the G# key inevitably accompanies unexpected touching of the A key. As a result, an A sound is generated via the A sound hole and the G# sound hole. It is well known that, when two or more sound holes are concurrently released for generation of one particular sound, the generated sound includes undesirable growl and lacks in crispness. For these reasons, it is quite difficult with the conventional key mechanism to generate crisp A sounds without any change in traditional finger motion.

SUMMARY OF THE INVENTION

It is the object of the present invention to enable generation of very crisp A sounds on a clarinet without any change in traditional finger motion.

In accordance with the basic aspect of the present invention, a key mechanism comprises a G# key unit, an A key unit and a control unit for inhibiting release of a G# sound hole when the G# key unit is operated during operation on the A key unit.

DESCRIPTION OF THE PREFERRED EMBODIMENTS

Figure 1:
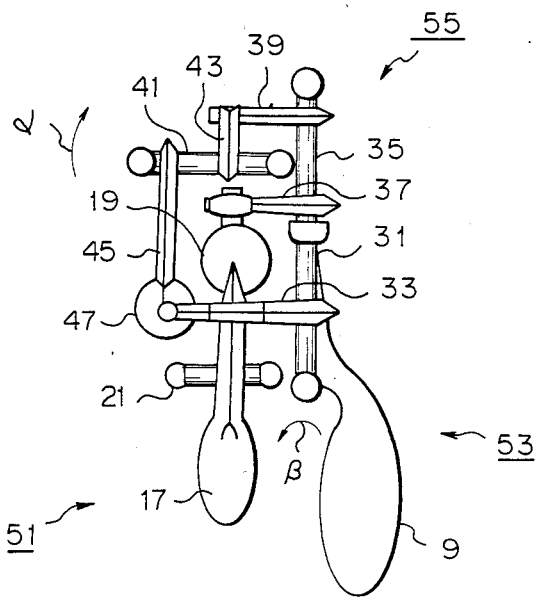
FIG. 1 is a front view of one embodiment of the key mechanism in accordance with the present invention.
Figure 2:
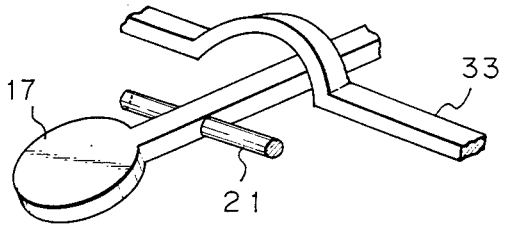
FIG. 2 is an enlarged perspective view of the main part of the key mechanism shown in FIG. 1.

One embodiment of the key mechanism in accordance with the present invention is shown in FIGS. 1 and 2, in which the key mechanism includes an A key unit 51, a G# key unit 53 and a control unit 55 mechanically combined with these two units 51 and 53.

The A key unit 51 includes an A key 17 swingably pivoted at its middle to a fixed pin 21 and a cap 19 fixed to the A key 17. This cap 19 controls the state of an A sound hole so that an A sound should be generated when the A sound hole is released by the cap 19.

The G# key unit 53 includes a G# key 9 secured to a rotary pin 31 which extends substantially normal to the fixed pin 21 of the A key unit 51. By a proper spring not shown in the drawing. the rotary pin 31 is constantly urged to axially rotate in the direction of an arrow $\beta$. A radially extending arm 33 is secured to the rotary pin 31 and provided with a midway arch astride the A key 17 of the A key unit 51 as shown in FIG. 2. Thanks to the presence of this midway arch, the A key 51 is allowed to freely swing about the fixed pin 21 without any contact with the radial arm 33. Below the free end of the radial arm 33 is located a cap 47 for controlling the state of a G# sound hole so that a G# sound should be generated when the G# sound hole is released by the cap 47. This cap 47 is held by an radial arm 45 fixed to a rotary pin 41 which extends substantially in parallel to the fixed pin 21 of the A key unit 51. By a proper spring not shown in the drawing, the rotary pin 41 is constantly urged to axially rotate in the direction of an arrow $\alpha$.

The control unit 55 includes a rotary pin 35 arranged in axial alignment with the rotary pin 31 of the G# key unit 53. This rotary pin 35 is provided with a pair of parallel and spaced radial arms 37 and 39. The free end of the radial arm 37 is fixed to the cap 19 of the A key unit 51. As a consequence, when the cap 19 lifts to release the A sound hole, the radial arm 37 swings upwards to axially rotate the rotary pin 35. Mounting of the radial arm 39 to the rotary pin 35 is adjusted so that the free end of the radial arm 39 should be located, via a prescribed gap, below the free end of a radial arm 43 secured to the rotary pin 41 of the G# key unit 53.

As described already, the rotary pin 41 of the G# key unit 53 is spring loaded to lift the cap 47 from the G# sound hole whereas the rotary pin 31 of the G# key unit 53 is spring loaded to press the free end of the radial arm 33 against the same cap 47. The spring load on the rotary pin 41 is designed weaker than the spring load on the rotary pin 31 so that the cap 47 should close the G# sound hole as long as the G# key 9 is left unoperated.

The above-described "prescribed gap" between the free ends of the radial arms 39 and 43 should be designed so that, both free ends should be brought into contact when the rotary pin 41 axially rotates in the $\alpha$ direction or the rotary pin 35 axially rotates in the counter $\beta$ direction on key operation, respectively.

With the above-described construction, the key mechanism operates as follows.

For generation of a G# sound, the G# key 9 is operated by the left index finger and the rotary pin 31 axially rotates in the counter $\beta$ direction. The radial arm 33 thereupon swings in the counter $\beta$ direction also. As a result, the free end of the radial arm 33 lifts from the cap 47 and the spring loaded rotary pin 41 is allowed to swing in the $\alpha$ direction to lift the cap 47 via the radial arm 45. Thus the G# sound hole is released for generation of the G# sound. Although rotation of the rotary pin 41 accompanies concurrent swing of the radial arm 43, this swing of the radial arm 43 is not hindered by the radial arm 39 thanks to presence of the prescribed gap between the arms 39 and 43.

For generation of an A sound, the A key 17 is operated by the left index finger and the cap 19 lifts from the A sound hole which is now ready for generation of the A sound. Lift of the cap 19 accompanies concurrent swing of the radial arm 37 coupled thereto in the counter $\beta$ direction and, via the rotary pin 35, the radial arm 39 is driven to swing in the counter $\beta$ direction too. As a result, the free end of the radial arm 39 contacts the free end of the radial arm 43. This condition maintained during operation on the A key 17. When the G# key 9 is unexpectedly operated by the left index finger during operation on the A key 17, the free end of the radial arm 33 lifts from the cap 47 for the G# sound hole, and the rotary pin 41 tends to axially rotate in the $\alpha$ direction. However, corresponding swing of the radial arm 43 in the $\alpha$ direction is inhibited by its contact with the radial arm 39. Thus, the rotary pin 41 is blocked against rotation in the $\alpha$ direction, the radial arm 45 is blocked against swing in the $\alpha$ direction and, as a consequence, the cap 47 is not allowed to release the G# sound hole. Thus, the A sound can be generated via the A sound hole only even when the G# key is operated unexpectedly during operation of the A key. As a consequence, the generated A sound is very rich in crispness without any change in the traditional finger motion.

I claim:

1. An improved key mechanism for a clarinet comprising:

a G# key unit having a G# key of a first cap for a G# sound hole, an A key unit having an A key of a second cap for an A sound hole and spaced from said G# unit, and a control unit mechanically combined with said G# and A key units in an arrangement such that release of said G# sound hole by said first cap is inhibited when said G# key is operated during operation on said A key.

2. An improved key mechanism as claimed in claim 1 in which:

said G# key unit further includes a first arm rigidly coupled to said G# key and spring loaded so as to press its free end against said first cap when said G# key is unoperated, a second arm secured to said first cap and spring loaded so as to lift said first cap from said G# sound hole, and a third arm rigidly coupled to said second arm, and said control unit includes fourth and fifth arms rigidly coupled to each other, the free end of said fourth arm being secured to said second cap, and the free end of said fifth arm being located below the free end of said third arm by a prescribed gap when said G# key is unoperated.

3. An improved key mechanism as claimed in claim 2 in which:

the spring load on said first arm is stronger than that on said second arm.

4. An improved key mechanism is claimed in claim 2 in which:

said first arm of said G# key unit extends normal to said A key and has a midway arch astride said A key.

* * * * *